US006643953B2

(12) United States Patent
Song et al.

(10) Patent No.: US 6,643,953 B2
(45) Date of Patent: Nov. 11, 2003

(54) CLOTHES DRYER UTILIZING SUCTION DUCT EXTENDING INTO DRUM INTERIOR

(75) Inventors: Sung Bae Song, Seoul (KR); Sang Wook Hong, Seoul (KR); Sang Heon Yoon, Seoul (KR); Hwan Joo Myung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/040,641

(22) Filed: Jan. 9, 2002

(65) Prior Publication Data

US 2003/0037460 A1 Feb. 27, 2003

(30) Foreign Application Priority Data

Aug. 22, 2001 (KR) ..... 2001-50755

(51) Int. Cl.[7] ..... F26B 11/02

(52) U.S. Cl. ..... 34/604; 34/607; 34/134; 34/138

(58) Field of Search ..... 34/130–132, 595, 34/602, 604, 605, 607, 609, 134, 138, 202, 218, 219

(56) References Cited

U.S. PATENT DOCUMENTS 4,112,590 A * 9/1978 Muller ..... 34/75
4,835,882 A * 6/1989 Dongelmans ..... 34/131
5,062,219 A * 11/1991 Harris et al. ..... 34/606
5,302,201 A * 4/1994 Lucke ..... 118/19
5,315,765 A * 5/1994 Holst et al. ..... 34/260
5,321,897 A * 6/1994 Holst et al. ..... 34/260
5,361,511 A * 11/1994 Brown ..... 34/468
5,544,428 A * 8/1996 Kuroda et al. ..... 34/493
5,706,588 A * 1/1998 Dausch et al. ..... 34/327
6,088,932 A * 7/2000 Adamski et al. ..... 34/274
6,105,533 A * 8/2000 Boos ..... 118/19

FOREIGN PATENT DOCUMENTS

EP 0 066 692 A2 * 12/1982 ..... D06F/58/02
EP 0 348 649 A1 * 1/1990 ..... D06F/58/20

* cited by examiner

*Primary Examiner*—Ira S. Lazarus
*Assistant Examiner*—Andrea M. Ragonese
(74) *Attorney, Agent, or Firm*—Birch, Stewart, Kolasch & Birch, LLP

(57) ABSTRACT

A clothes dryer in accordance with the present invention includes a drum rotatably supported in a case having an interior space for drying clothes. Air for drying clothes is supplied to the suction duct that is connected to one side of the drum. An extension duct extending from the suction duct into the drum supplies the air from the suction duct into the drum. An exhaust duct is connected to the other side of the drum for exhausting the air that is used to dry clothes to the outside of the case. The clothes dryer uniformly dries clothes inputted into the drum as the dryer directly transmits heated air to the center portion of the drum, thereby improving clothes drying efficiency.

21 Claims, 7 Drawing Sheets

CLOTHES DRYER UTILIZING SUCTION DUCT EXTENDING INTO DRUM INTERIOR

BACKGROUND OF THE INVENTION

1. Field of the Invention

The present invention relates to a clothes dryer, and more particularly to a clothes dryer capable of circulating heated air to the inside of a drum and discharging the air which has dried clothes within the drum.

2. Description of the Background Art

Generally, a clothes dryer is an apparatus for automatically drying wet clothes after the clothes have been washed. The clothes dryer is installed separately from a washing machine and is typically classified as a dehumidifying-type or an exhausting-type clothes dryer.

The dehumidifying-type incorporates a method for drying clothes by condensing moisture circulating in the air in the drum, exhausting water generated by this condensing step to the outside of the dryer and supplying air to the inside of a drum heating the air. The exhausting-type incorporates a method for drying clothes by guiding external air of the dryer to the inside of the drum after drawing in and heating the air, and exhausting the air to the outside of the dryer again.

FIG. 1 is a view of an exhausting-type clothes dryer of the background art. FIG. 2 is a cross-sectional view taken along section line A—A of FIG. 1. The clothes dryer of the background art will be described in greater detail hereinafter. As seen in FIG. 1, the clothes dryer includes a case 1 having an input opening 1*a* on the front surface, a door 2 for opening and closing the input opening 1*a* of the case 1, a rotatable drum 3 installed in the case 1 for receiving clothes and having a plurality of baffles (not shown) protruding from an inner circumferential surface, a driving motor 4 and a transmission device 5 installed in the case 1 for rotating the drum. The dryer also includes an air circulation unit 7 for exhausting external air of the case 1 to the outside of the case 1 after circulating the air into the drum 3 and a heater 6 installed at the inlet side of the suction duct 7A of the above air circulation unit 7 for heating air circulated into the drum.

The drum 3 includes a body 3A that rotates while connected to the driving motor 4, the transmission device 5 and movable side plates 3B and 3C combined with the body 3A at both sides of the body 3A. The body 3A has a cylindrical shape and the baffles are formed on the circumferential surface at the inner side as a single body.

The side plates 3B and 3C are all formed in a circular plate shape and a suction port 3*b* connected with the suction duct 7A of the air circulation unit 7 is formed on the rear side plate 3B. The exhaust port 3c is formed on the front side plate 3C and is connected with an exhaust duct of the air circulation unit 7.

The driving motor 4 includes a single-direction rotary motor that rotates in the same direction and speed having a driving shaft extending in an axial direction. The transmission device 5 includes a pulley 5*a* combined with a driving shaft at a side of the driving motor 4 and a belt 5*b* connected from the pulley 5*a* to the body 3A of the drum 3 for transmitting the rotational force of the driving motor 4.

The heater 6 is installed at the inlet side of the suction duct 7A either adjacent to or combined with the inlet side. The heater can be a conventional electric heater or gas heater. The air circulation unit 7 includes the suction duct 7A for guiding air in the case 1 into the drum 3, the exhaust duct 7B for exhausting the air in the drum 3 to the outside of the case 1 and a fan 7C positioned at the center of the exhaust duct 7B for circulating air.

The suction duct 7A is installed to guide air that is heated while it passes the heater 6 after the air circulates to the inside through the air circulation port 1*b* of the case 1 to the inside of the drum 3. The inlet is positioned adjacent to or combined with the rear of the heater 6 and the outlet is connected with the suction port 3*b* of the drum 3. The exhaust duct 7B has an inlet connected to the suction port 3*b* of the drum 3 and the outlet extends to the outside penetrating the rear wall of the case 1.

The fan 7C is attached to a driving shaft of one side of the driving motor 4 that is also connected at a second side to the transmission device 5 in the exhaust duct 7B. The fan is a single inlet centrifugal fan having a suction side and an exhaust side respectively. In FIG. 1, a clothes input opening 3*d* of the drum and a filter F are also shown.

The operation of the clothes dryer of the background art with the above-described features will be described in greater detail hereinafter. When power is applied to the driving motor 4, the drum 3 is rotated by the belt 5*b* and clothes in the drum 3 are mixed. External air is heated as the fan 7C rotates, and the air is then supplied to the inside of the drum 3 and dries the wet clothes.

When the fan 7C is operated, the external air is drawn into the case 1 and the air is heated as it passes the heater 6. The heated air is then circulated to the inside of the drum 3 through the suction duct 7A and the suction port 3*b*. The heated air circulated within the drum dries the wet clothes and is then exhausted to the outside of the case 1 through the exhaust port 3*c* and the exhaust duct 7B.

However, since the suction port 3*b* of the drum 3 is formed having a simple punched-hole shape on the rear side plate 3B, heated air drawn into the inner side of the drum 3 moves to the side of the front side plate 3C along the upper portion of the inner circumferential surface of the drum 3 and is then exhausted. Therefore, the air is prevented from contacting the clothes positioned at the center portion of the drum 3. Accordingly, clothes in the drum 3 are not dried uniformly, clothes drying efficiency is reduced and the time for drying clothes is increased.

Further, when heated air flows into the drum 3 through the suction duct 7A, it tends to flow to the upper side. However, as shown in FIG. 2, since the suction port 3*b* formed on the rear side plate 3B is narrow at the upper side and wide at the lower side, air flow resistance is increased and the amount of air inflow for the same cross section of the suction port 3*b* is decreased, thereby decreasing clothes drying efficiency.

Since the suction duct 7A and the exhaust duct 7B are positioned at the front and rear sides of the drum 3, the volume of the drum 3 is decreased when compared to the volume of the same case 1. Since the volume of the drum 3 must be increased to dry larger amounts of clothes, the entire volume of the case 1 is disadvantageously increased.

Clothes may be efficiently dried when the direction and speed of rotation of the drum 3 is changed irregularly. However, since the clothes dryer of the background art described above drives the drum 3 and fan 7C simultaneously using a single driving motor 4, the fan is rotated in a single direction. Therefore, the drum 3 rotates only in one direction, and drying efficiency is decreased in the clothes dryer of the background art.

SUMMARY OF THE INVENTION

The present invention overcomes the shortcomings associated with the background art and achieves other advantages not realized by the background art.

Therefore, the present invention provides a clothes dryer capable of improving clothes drying efficiency by uniformly drying clothes inputted into a drum, wherein heated air is directly transmitted to the center portion of the drum.

Another object of the present invention is to provide a clothes dryer capable of decreasing the time required for drying clothes by increasing the amount of the heated air supplied into the drum.

Still another object of the present invention is to provide a clothes dryer capable of increasing the amount of laundry dried by increasing the volume of the drum without increasing the size of the case.

Still another object of the present invention is to provide a clothes dryer capable of improving drying efficiency by independently driving the drum and fan and varying direction and speed of rotation.

One or more of these and other objects of the present invention are accomplished by a clothes dryer comprising a case; a drum rotatably supported in the case and having a space for drying clothes within the drum; a suction duct being connected to a first side of the drum for supplying air to the drum for drying clothes; an extension duct extending from the suction duct into the drum, wherein air supplied from the suction duct into the drum flows through a plurality of air holes within the extension duct; and an exhaust duct being connected to a second side of the drum for exhausting air within the drum to an exterior of the case.

One or more of these and other objects of the present invention are also accomplished by a clothes dryer, comprising a case; a drum rotatably supported in the case and having a space for drying clothes within the drum; a suction duct being connected to a first side of the drum for supplying air to the drum for drying clothes; an extension duct extending from the suction duct into the drum, wherein air supplied from the suction duct into the drum flows through the extension duct; and an exhaust duct connected to a second side of the drum for exhausting air within the drum to an exterior of the case; wherein the drum has two air suction ports connected to the suction duct on a rear side of the drum and the extension duct is connected to a first air suction port of the two air suction ports.

One or more of these and other objects of the present invention are also accomplished by a clothes dryer comprising a case; a drum having a rotatable body supported in the case, and a front plate and a rear plate engaged with stationary front and rear sides of the body; a suction duct being connected to the rear plate of the drum supplying air to the drum for drying clothes; an extension duct extending from the suction duct into the drum, wherein air supplied from the suction duct into the drum flows through the extension duct toward a rotational center of the drum; and an exhaust duct connected to the front plate of the drum for exhausting air to an exterior of the case, wherein the front plate of the drum includes a cylindrical portion extending a certain length in a longitudinal direction of the body from an outer circumferential surface of the drum, the cylindrical portion having an exhaust port at a lower portion thereof, and the exhaust duct is connected to the exhaust port of the cylindrical portion.

One or more of these and other objects of the present invention are also accomplished by a clothes dryer comprising a case; a drum having a rotatable body supported in the case, and a front plate and a rear plate engaged with stationary front and rear sides of the body; a suction duct being connected to the rear plate of the drum supplying air to the drum for drying clothes; an exhaust duct being connected to the front plate of the drum for exhausting air to an exterior of the case; and an air suction port formed on the rear plate of the drum and connected to the air suction port, wherein the air suction port is formed having a tapered shape increasing in area as the air suction port extends away from a rotational center of the drum.

One or more of these and other objects of the present invention are is also accomplished by a clothes dryer, comprising a case; a drum rotatably supported in the case and having an interior space for drying clothes within the drum; a suction duct being connected to a first side of the drum supplying air to the drum for drying clothes; an extension duct extending from the suction duct into the drum, wherein air supplied from the suction duct into the drum flows through a plurality of air holes within the extension duct toward a rotational center of the drum; a first exhaust duct being connected to a second side of the drum for exhausting air within the drum to the outside of the case; and a second exhaust duct diverging from the first exhaust duct for exhausting a portion of the air exhausted from the drum to a front side of the suction duct.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
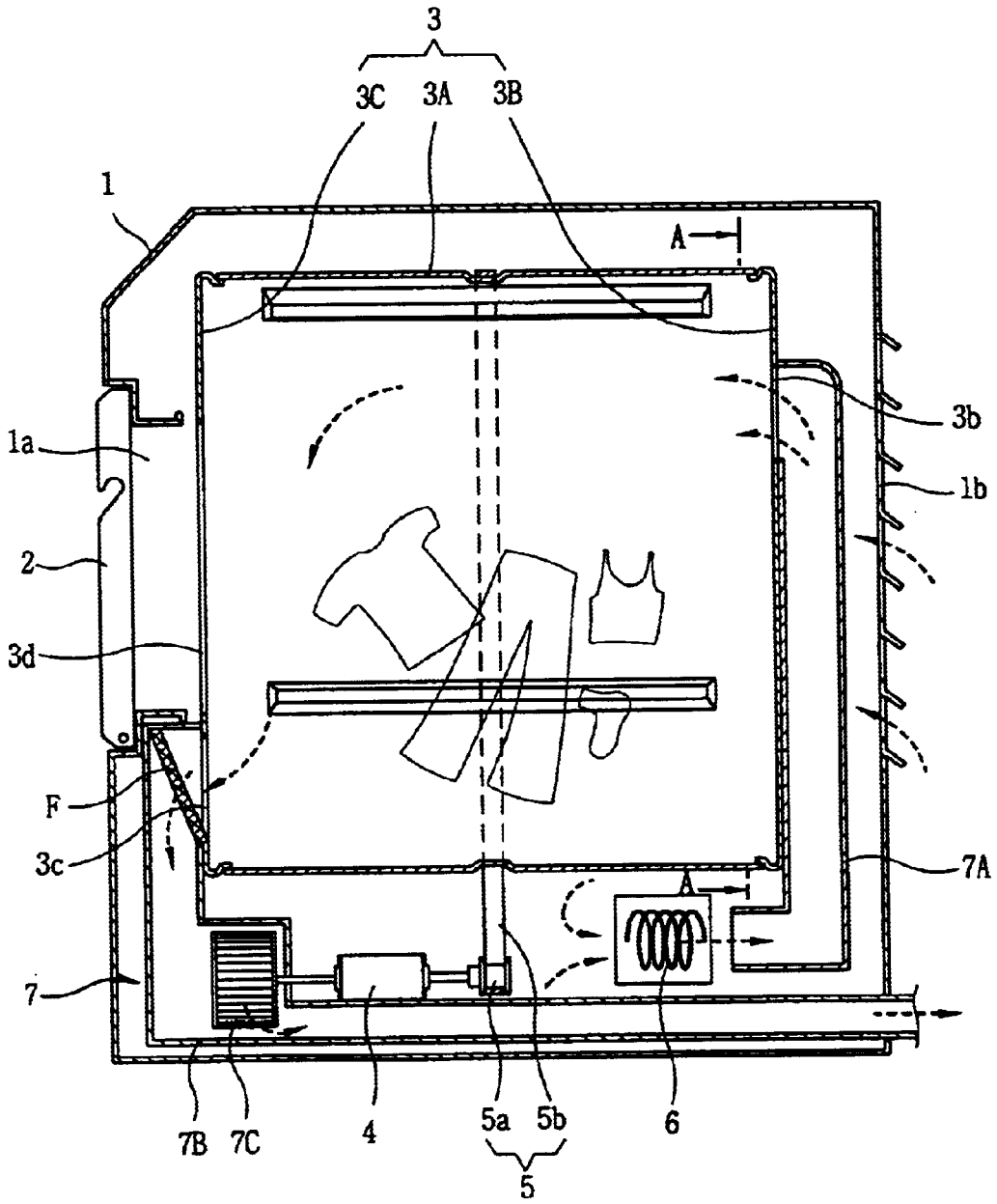
FIG. 1 BACKGROUND ART
FIG. 1 is a longitudinal sectional view showing a clothes dryer of the background art.
Figure 2:
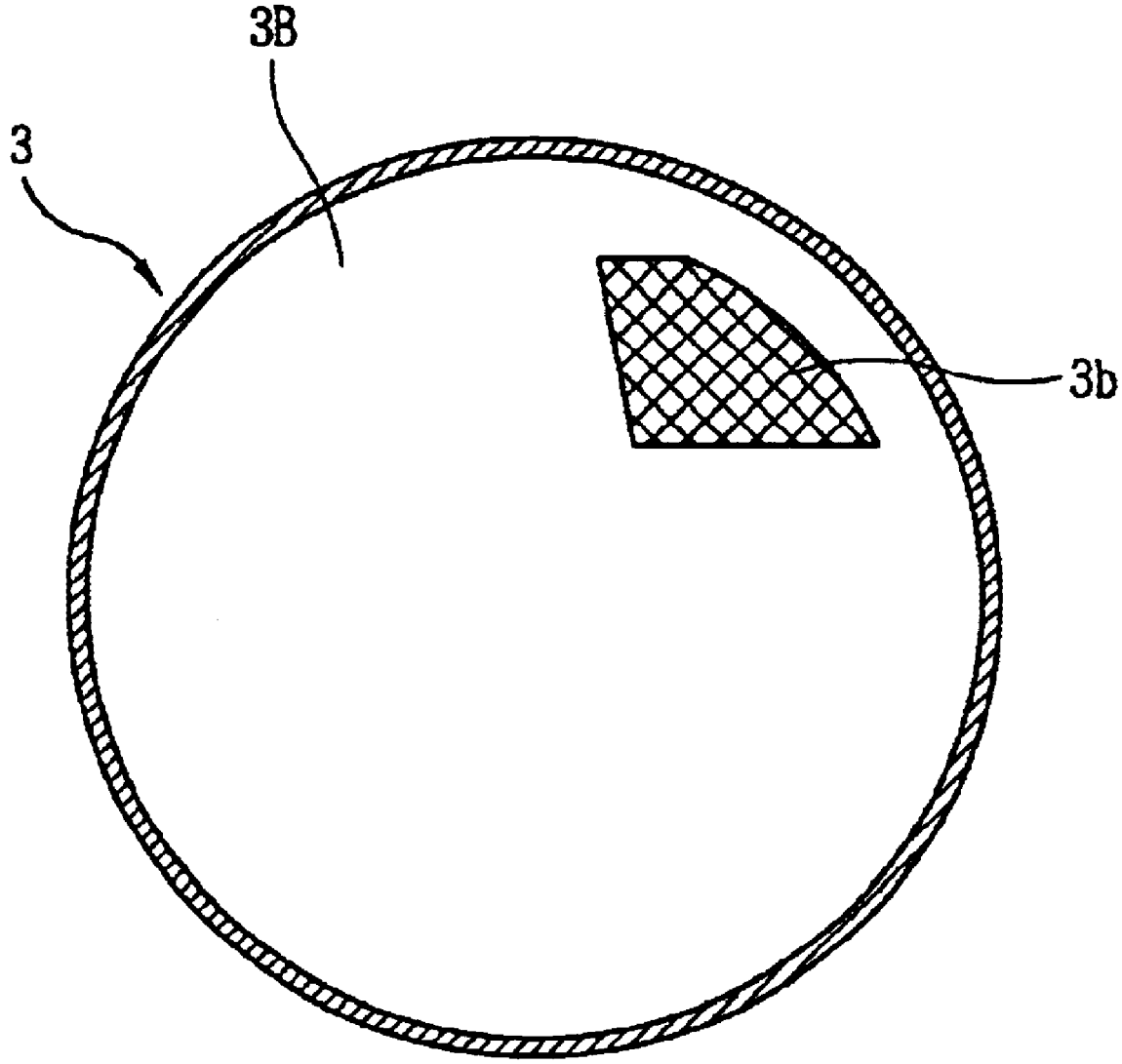
FIG. 2 BACKGROUND ART
FIG. 2 is a cross-sectional view taken along section line A—A of FIG. 1 showing and a front view showing a rear side plate of a drum.
Figure 3:
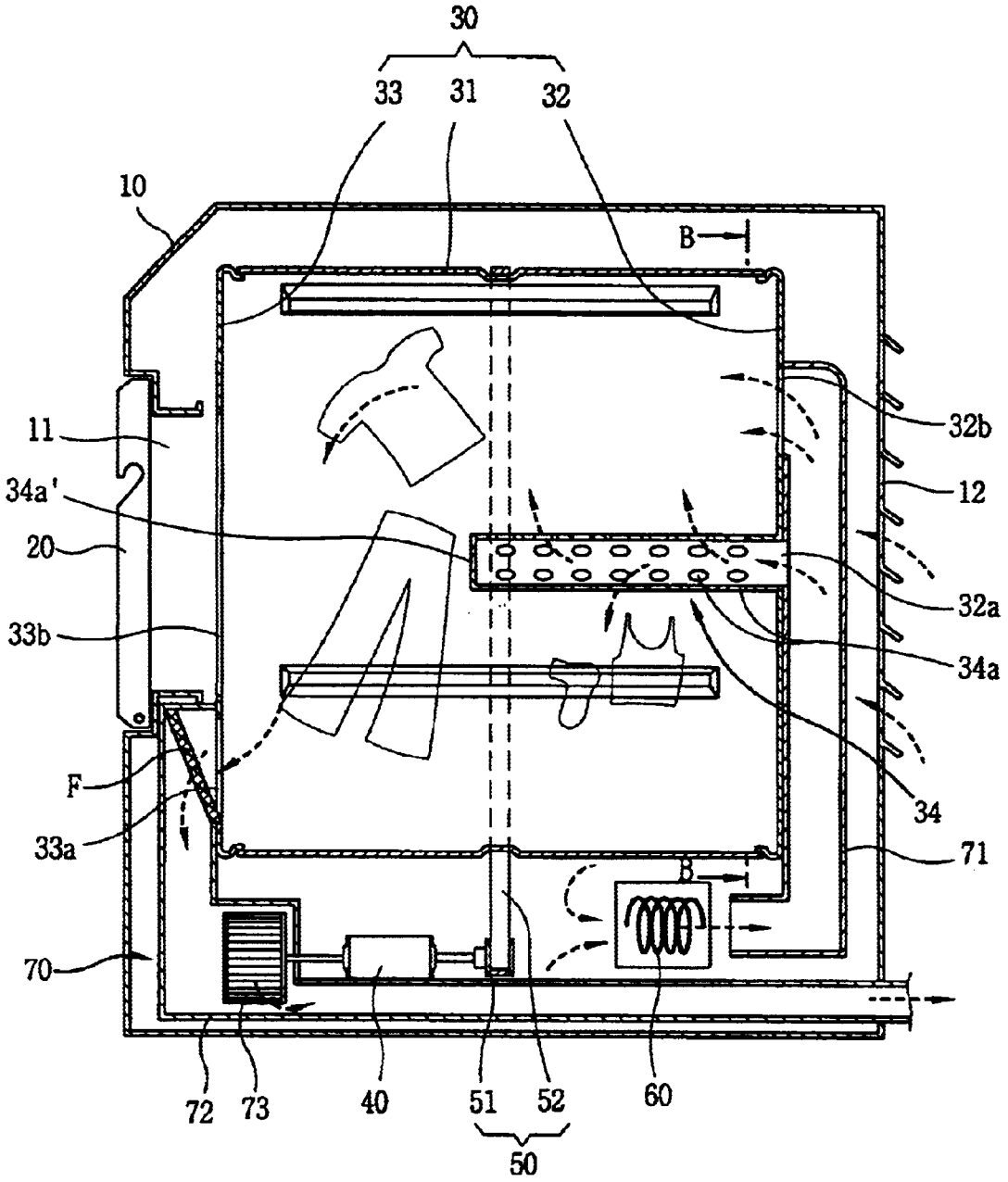
FIG. 3 is a longitudinal sectional view showing a clothes dryer in accordance with a first embodiment of the present invention.
Figure 4:
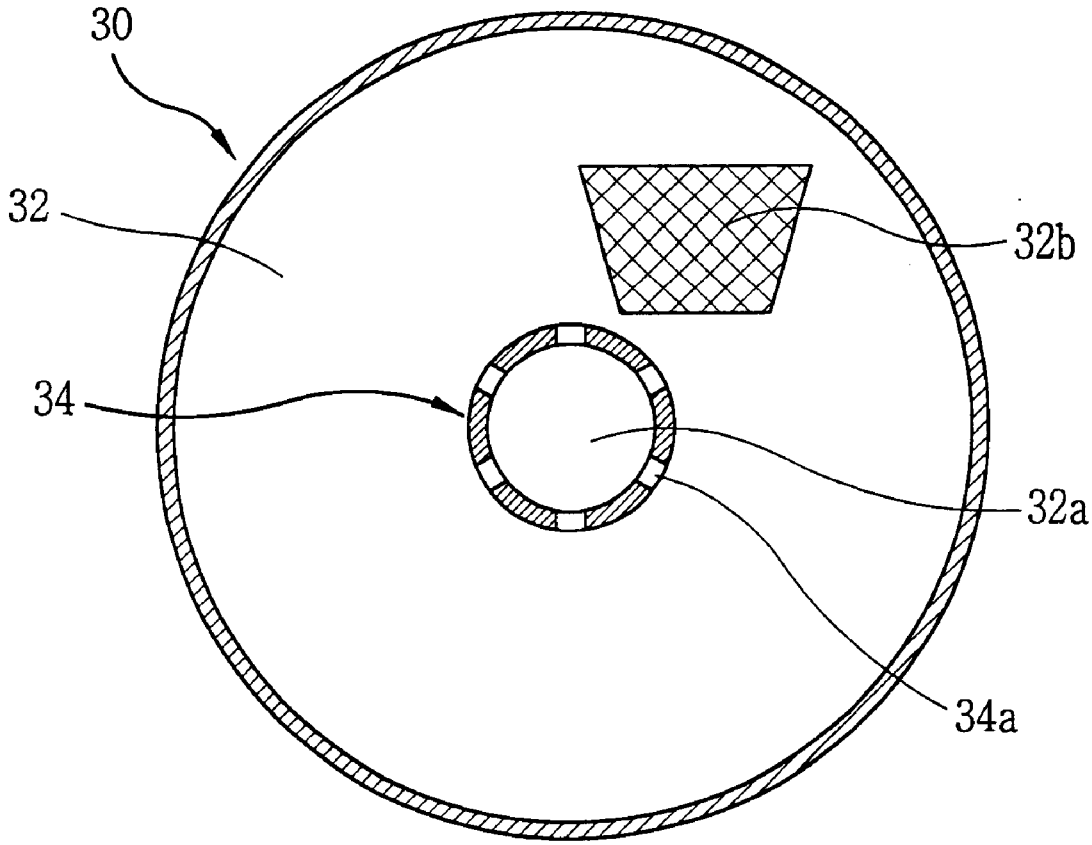
FIG. 4 is a cross-sectional view taken along section line B—B of FIG. 3 showing and a front view showing a rear side plate of a drum.

The present invention will hereinafter be described with reference to the accompanying drawings. FIG. 3 is a longitudinal sectional view showing a clothes dryer in accordance with a first embodiment of the present invention. FIG. 4 is a cross-sectional view taken along section line B—B of FIG. 3 showing a front view of a rear side plate of a drum. In FIGS. 3 and 4, reference numerals that are the same as the above-described clothes dryer of the background art utilize the same reference numerals.

With reference to FIG. 3, the clothes dryer in accordance with the first embodiment of the present invention includes a case 10 having an input opening 11 on the front surface and air inflow holes or inlet ports 12 on the rear side, a door 20 for opening and closing the input opening 11 of the case 10, and a drum 30 rotatably installed in the case 10. The drum 30 receives clothes and includes a plurality of baffles (not shown) protruding from an inner circumferential surface. The clothes dryer also includes a driving motor 40 positioned in the case 10 for generating a rotational force, a transmission device 50 for transmitting the rotational force of the driving motor 40 to the drum 30, an air circulation unit 70 for drawing in the external air of the case 10 into the drum 30 and exhausting the air which had been used for drying clothes in the drum 30 to the outside of the case 10. A heater 60 is also installed at the inlet side of the air circulation unit 70 for heating air flowing into the drum.

The drum 30 includes a rotating body 31 having a cylindrical shape connected to the driving motor 40 and the transmission device 50, and a rear side plate 32 and a front side plate 33 combined with both side surfaces of the body 31 and capable of performing relative movement. An opening 33*b* in the front side plate 33 is provided to permit access to the drum 30.

With reference to FIG. 4, the rear side plate 32 is formed in the shape of a circular plate and the first and second air suction ports 32*b* and 32*a* are connected to the suction duct 71 of the air circulation device 70 on the plate. An extension duct 34 extending into the body 31 is positioned and assembled thereafter, or formed as a single body when it is manufactured at the second air suction port 32*a*.

Here, the second air suction port 32*a* is formed in a circular shape and connected with the extension duct 34. The first air suction port 32*b* is formed in the shape of an inverted trapezoid which becomes gradually wider from the lower portion to the upper portion so that air ascending through the suction duct 72 flows into the drum 30 through the first half portion of the air suction port.

Also, it is desirable that one air suction port, e.g., the first air suction port 32*b*, of the air suction ports 32*a* and 32*b* is formed at a right center portion of the rear side plate 32. The remaining air suction port, e.g., the second air suction port 32*a* is formed in a first half portion with respect to the left and right sides, or a second half portion. The ideal air suction port positioning can be determined by considering the location where clothes fall within the drum during operation. Accordingly, drying efficiency is improved by increasing the distribution of air interacting with the clothes in the drum.

The extension duct 34 extends along a direction of the rotational center of the drum 30 with respect to the longitudinal direction of the drum. The extension duct 34 is formed having the same diameter along its length in a preferred embodiment. The extension duct 34 can be formed having a cylindrical shape having an end portion closed or as a cylindrical structure in a tapered shape having a smaller diameter gradually decreasing in size from the first end to the end portion, e.g., farthest from the rear side plate 32.

Also, air holes 34*a* and 34*a*' connected with the second air suction port 32*a* are radially formed on the circumferential and end surfaces of the extension duct 34 for supplying air from the center portion of the drum 30 in the radial direction, e.g., either at regular or irregular intervals. The air holes 34*a* can have varying diameters along the extension duct 34. The ideal size and positioning of the air holes 34*a* is determined by considering the clothes drying process and relative position of falling clothes within the drum 30.

The front side plate 33 is formed in the shape of a circular plate like the rear side plate 32. An air exhaust port 33a connected to the exhaust duct 72 of the air circulation device 70 and the drum 30 is formed on the front side plate 33.

The driving motor 40 is a single-direction rotary motor that rotates in the same direction and at the same speed having driving shafts extending in two directions. A first driving shaft is combined with the transmission device 50 for rotating the drum 30 and the other driving shaft is combined with a fan 73 of the air circulation unit 70.

The transmission device 50 includes a pulley 51 combined with the driving shaft at a side of the driving motor 40 and a belt 52 connected from the pulley 51 to the body 31 of the drum 30 for transmitting the rotational force of the driving motor 40 to the body 31. The heater 60 is formed as an electric heater or gas heater and is installed at the inlet side of the suction duct.

The air circulation unit 70 includes the suction duct 71 to circulate the air flowing through the inlet port 12 of the case 10 into the drum 30, the exhaust duct 72 connected to exhaust the air in the drum 30 to the outside, a suction increasing duct 74 installed on a side surface of the exhaust duct 72 for supplying air from the inside of the case 10 to the inlet side of the heater 60 and a double inlet fan 73 installed at the center of the exhaust duct 72 and the suction increasing duct 74 for drawing in and exhausting the air in two directions.

The inlet portion of the suction duct 71 has the inlet portion positioned at the rear of the heater 60 and the outlet portion installed connected to the suction ports 32*a* and 32*b* of the drum 30. Since the outlet portion must be connected with the respective air suction ports 32*a* and 32*b* of the drum 30 in the inlet portion of the suction duct 71, the inlet portion in the present embodiment can be formed as a single pipe or the outlet portion can be formed as a plurality of diverged pipes with the same number of air suction ports 32*a* and 32*b*. Alternatively, the inlet and outlet ports can each be formed as a single pipe.

The exhaust duct 72 has an inlet portion connected to the exhaust port 33*a* of the drum 30 and an outlet portion extending to the outside and penetrating the case 10. Here, the exhaust duct 72 is connected to the air exhaust port 33*a* at the front side of the front side plate 33. The fan 73 is connected to the driving shaft of the other side of the driving motor 40 so that it rotates in the same direction and speed as the transmission device 50. A filter F for filtering air discharged from the drum 30 is also provided.

Figure 5:
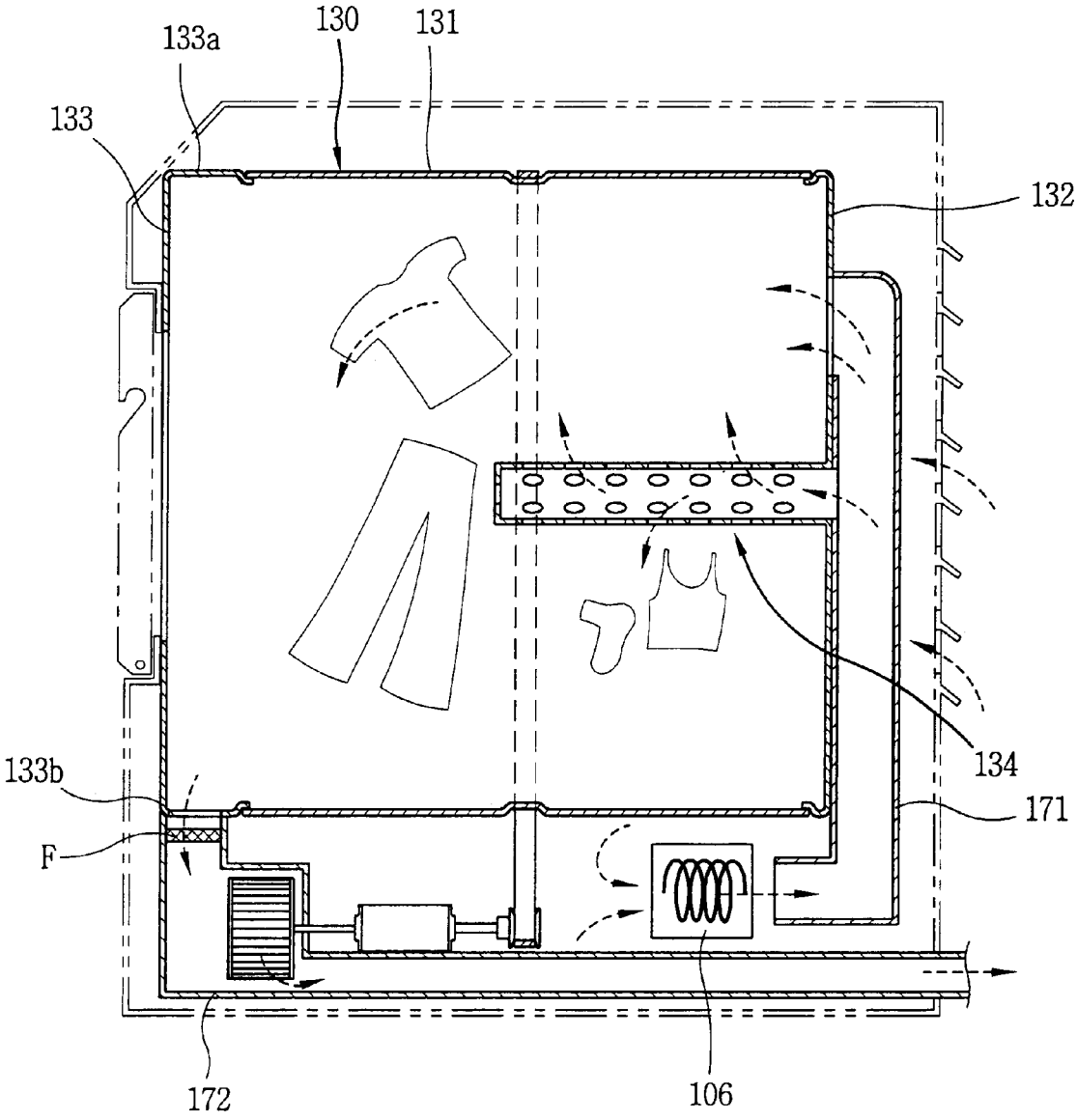
FIG. 5 is a longitudinal sectional view showing a clothes dryer in accordance with a second embodiment of the present invention.

FIG. 5 is a longitudinal sectional view showing the clothes dryer in accordance with the second embodiment of the present invention. The clothes dryer in accordance with the second embodiment of the present invention has the same general construction as the first embodiment, but the rear side plate 132 of the drum 130 and an exhaust duct 172 are different.

A front side plate 133 includes the drum 130 that has a cylindrical portion 133*a* extending a certain length in the longitudinal direction of a body 131 along the outer circumferential surface. An exhaust port 133*b* connected to the exhaust duct 172 at the lower side of the cylindrical portion 133*a* is also provided.

At the center of the rear side plate 132 of the drum 130, an extension duct 134 is installed as in the first embodiment. The extension duct 134 and the suction duct 171 are connected and a heater 106 supplies heated air through both ducts 134, 171. The rear side plate 132 is formed in the form of a simple circular plate and sized in proportion to the volume of the suction duct 171. The second embodiment of the present invention with the above composition is the same as the above first embodiment except for the parts described hereinabove.

Figure 6:
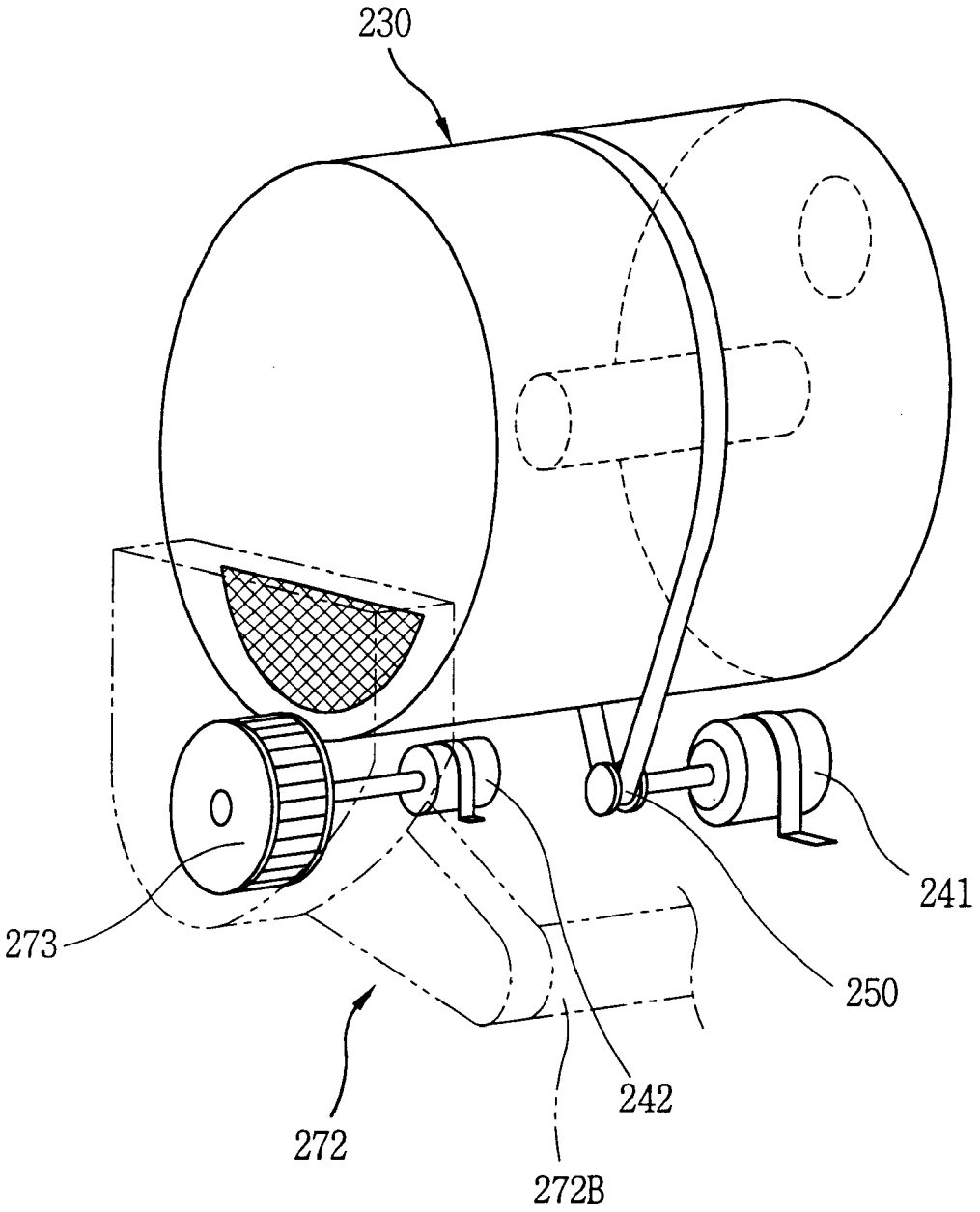
FIG. 6 is a perspective view showing a clothes dryer in accordance with a third embodiment of the present invention.
Figure 7:
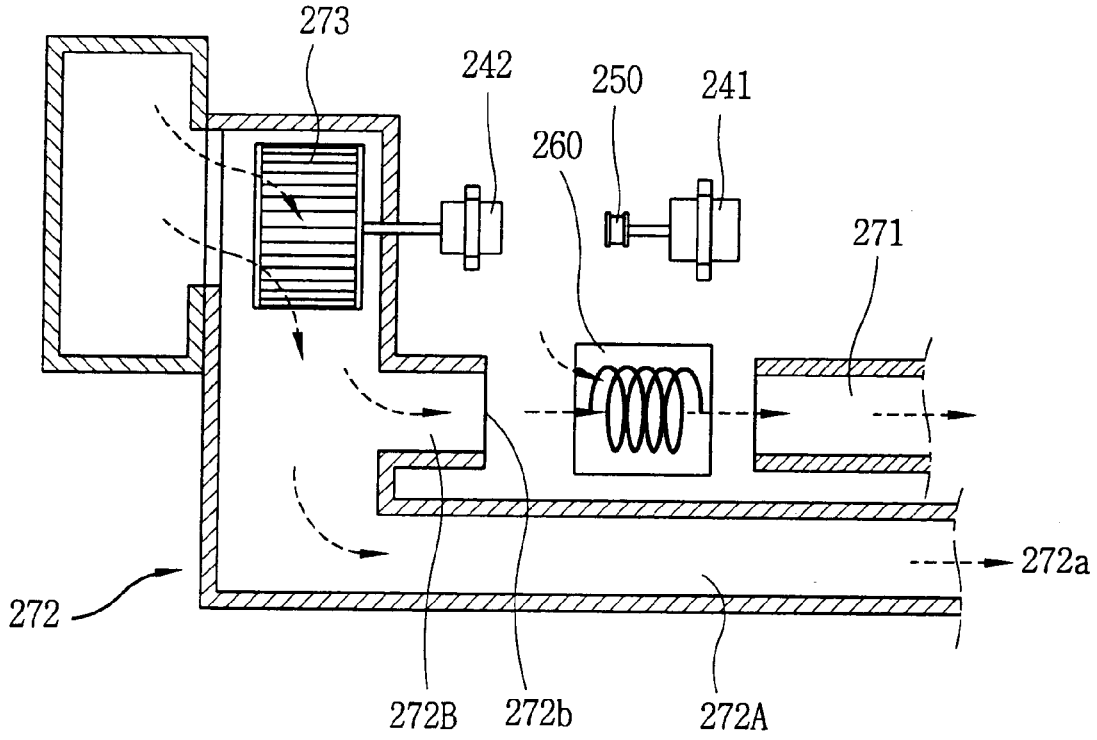
FIG. 7 is a sectional view showing an exhaust duct portion in FIG. 6.

FIG. 6 is a perspective view showing the clothes dryer in accordance with the third embodiment of the present invention. FIG. 7 is a sectional view showing the exhaust duct portion in FIG. 6. In the clothes dryer in accordance with the third embodiment of the present invention, an exhaust duct 272 has a plurality of exhaust ports 272*a* and 272*b* and one of the ports is capable of exhausting air to a heater 260 that is the inlet portion of a suction duct 271.

In the first exhaust duct 272A of the exhaust duct 272, an exhaust port 272*a* is positioned outside the case (not shown) and connected to the outside to exhaust air. A second exhaust duct 272B diverges from the first exhaust duct and is positioned at the front of the heater 260 to exhaust air to the heater 260 and permit a flow air into the suction duct 271.

In the third embodiment of the present invention, the second exhaust duct 272B is provided to permit a part of the air which had been used to dry clothes in the drum 230 to be supplied into the drum 230 through the heater 260 and suction duct 271 again, e.g., recirculation of some of the air used for drying clothes to reduce the time required for heating of air. At the same time, a portion of the air flowing into the suction duct 271 is increased and the amount of air flowing into the drum 230 can be increased, e.g., to shorten the time required for the drying of clothes.

The clothes dryer in accordance with the third embodiment of the present invention has a plurality of driving motors 241 and 242. Accordingly, the dryer can drive a fan 273 and the drum 230 independently. In the first motor 241, the driving shaft is combined with a transmission device 250 and rotates the drum 230. In the second motor 242, the driving shaft is combined with the fan 273 and rotates the fan.

Therefore, the driving motors 241 and 242 can control the drum 230 and the fan 273 to rotate in different directions and speed, while varying the direction and speed according to the type or amount of the clothes in the clothes dryer to dry clothes more efficiently and to shorten the time required for drying clothes. Therefore, the clothes dryer in accordance with the third embodiment of the present invention is the same as that of the first embodiment except for the specific parts described above.

As described in the third embodiment, if a clutch and transmission device which can change the rotational direction and speed of the motor are positioned on a driving shaft connected with the fan or transmission device in the first driving motor, the drum and fan can be controlled with different rotational directions and speeds using a single driving motor, e.g., without using a plurality of driving motors 241 and 242.

The operation and effect of the clothes dryer in accordance with the present invention will be described hereinafter with reference to the first through third embodiments. With reference to FIG. 3, when power is applied to the driving motor 40, the drum 30 mixes clothes at the inner side of the drum 30 as it is rotated by the belt 52, and the fan 73 rotates and draws in the outside air to the inside of the case 10.

As the air drawn in is heated by the heater 60, the air flows into the drum 30 through the suction duct 71 and air suction port 32*a*, or the suction duct 71 and the extension duct 34 and dries the clothes in the drum 30. The air is then exhausted to the outside of the case 10 through the air exhaust port 33*a* and the exhaust duct 72.

At this time, the air flowing into the drum through the suction duct 71 is supplied through the air suction ports 32*a* and 32*b* positioned on the rear side plate of the drum 30. The air of the air suction port 32*b* not connected to the extension duct 34 mainly dries clothes at the outer side moving along the circumferential surface of the drum. Air supplied from the air suction port 32*a* connected with the extension duct 34 and the air holes 34*a* of the extension duct 34 after passing through the air suction port 32*a* moves from the center of the drum to the circumferential surface and dries clothes mainly at the inner side of the drum.

Therefore, in the clothes dryer in accordance with the present invention, the heated air is supplied to the inner and outer sides of the clothes through the air suction ports 32*a* and 32*b*. Accordingly, the clothes can be dried more efficiently and quickly.

If the extension duct 34 is formed in a tapered shape wherein the diameter decreases from the beginning to the end with respect to the air flowing direction, the air can be exhausted at the end of the extension duct 34 at a constant or predetermined pressure even though the air is leaked through the air holes 34*a* formed at the beginning portion of the extension duct 34. Therefore, clothes positioned at the front and rear sides of the drum can still be dried more uniformly.

Also, if the inflow amount of the heated air is increased by increasing the diameter of the air hole 34*a* corresponding to the position where the clothes fall within the drum, the air holes 34*a* may have different diameters of along the extension duct 34.

Also, as the extension duct 34 is extends along the shaft direction of the drum 30, the clothes which rotate with the drum 30 can be prevented from becoming tangled. Accordingly, efficiency of clothes drying can be increased.

As the air heated by the heater 60 can be supplied closer to the center portion of the clothes which will be dried, and the heated air can be equally distributed to the inner side and the outer side of larger amounts of clothes, drying performance is substantially improved with the present invention. Accordingly, the time required for drying clothes is reduced and electricity consumption can be reduced.

As shown in FIG. 4, the air suction port 32*b* which is not connected to the extension duct 34 between the air suction ports 32*a* and 32*b* is formed wider at an upper side and narrower at a lower side. The air suction port 32*b* is positioned at the second half portion of the rear side plate 32, e.g., at a position higher than the extension duct 34. Accordingly, the amount of air drawn into the drum 30 can be increased and the distribution of the air with the clothes is increased to improve drying efficiency. The air in the drum 30 that has dried clothes is exhausted to the outside of the case 10 through the air exhaust port 33*a* and exhaust duct 72 positioned at the opposite side of the air suction ports 32*a* and 32*b*, or the extension duct 34.

As seen in FIG. 5, since the air exhaust port 133*a* is formed at the cylindrical portion 133*a* of the front side plate 133 in the clothes dryer in accordance with the second embodiment of the present invention, the space where the exhaust duct was positioned in the first embodiment, e.g., at the front side of the drum 130, is not necessary, and the entire volume of the drum 130 can be increased. Therefore, the amount of clothes drying can be increased without increasing the whole volume of the case.

As seen in FIG. 7, the exhaust duct 272 is divided into a plurality of ducts and the first exhaust duct 272A is extends to the outside of the case in the clothes dryer in accordance with the third embodiment of the present invention. Since the second exhaust duct 272B extends to a position facing the inlet side of the heater 260, part of the heated air passing through the drum 230 is recirculated to the drum 230 through the heater 260 and the suction duct 271. Therefore, the time required for heating air in the heater 260 can be reduced and the amount of air being drawn into the drum 230 is increased to further improve drying efficiency.

As seen in FIGS. 6 and 7, since a first motor 241 for driving the drum 230 and a second motor 242 for driving the fan 273 are positioned in the clothes dryer in accordance with the second embodiment of the present invention, the first motor 241 and the second motor 242 can be controlled independently and the direction and speed of the rotation can be controlled differently. Accordingly, the time required for drying is reduced and drying efficiency is improved with the present invention.

For example, the second motor 242 is driven at high speed in a first drying step and then the clothes can be dried evenly by lowering the speed. Also, the first motor 241 can prevent the clothes from being tangled by changing the rotational direction to further increase drying efficiency.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A clothes dryer comprising:

a case;

a drum rotatably supported in the case and having a space for drying clothes within said drum;

a suction duct being connected to a first side of the drum for supplying air to said drum for drying clothes;

an extension duct extending from the suction duct into the drum, wherein air supplied from the suction duct into the drum flows through a plurality of air holes within said extension duct; and an exhaust duct being connected to a second side of the drum for exhausting air within said drum to an exterior of said case.

2. The dryer according to claim 1, wherein the extension duct extends to a position aligned with a rotational center of the drum with respect to a longitudinal direction of the drum.

3. The dryer according to claim 1, wherein the extension duct has an end portion extending to a center portion of the drum.

4. The dryer according to claim 1, wherein the extension duct is formed in a cylindrical shape and said plurality of air holes are formed on circumferential and end surfaces of said extension duct.

5. A clothes dryer, comprising:

a case;

a drum rotatably supported in the case and having a space for drying clothes within said drum;

a suction duct being connected to a first side of the drum for supplying air to said drum for drying clothes;

an extension duct extending from the suction duct into the drum, wherein air supplied from the suction duct into the drum flows through said extension duct; and an exhaust duct connected to a second side of the drum for exhausting air within said drum to an exterior of the case; wherein the drum has two air suction ports connected to the suction duct on a rear side of the drum and the extension duct is connected to a first air suction port of said two air suction ports.

6. The dryer according to claim 5, wherein a first air suction port of said two air suction ports which is not connected to the extension duct is formed a certain distance apart from a rotational center of the drum.

7. The dryer according to claim 5, wherein a second air suction port of said two air suction ports which is connected to the extension duct is positioned at a rotational center of the drum.

8. The dryer according to claim 5, wherein a first air suction port of said two air suction ports which is not connected to the extension duct is formed having a surface area increasing along a direction extending from a rotational center of said drum toward an outer circumferential surface of said drum.

9. The dryer according to claim 1, wherein the drum comprises a rotating body having a cylindrical shape, a stationary front plate and a stationary rear plate engaged with front and rear sides of the body, an inlet portion of the exhaust duct connected to the front plate, and the suction duct and the extension duct are connected to the rear plate.

10. The dryer according to claim 9, wherein the exhaust duct is connected at a front side of the front plate.

11. The dryer according to claim 9, wherein the front plate has a cylindrical portion extending a certain length in a longitudinal direction of the body from an outer circumferential surface of the rotating body and the exhaust duct is connected to an exhaust port formed at the lower side of the cylindrical portion.

12. The dryer according to claim 1, wherein the exhaust duct recirculates a portion of the air exhausted from within the drum back into the drum through the suction duct.

13. The dryer according to claim 1, wherein a heater for heating suction air is installed at an inlet portion of the suction duct and the exhaust duct discharges a portion of the air exhausted from the drum to a front side of the heater and recirculates the portion of the air into the drum.

14. The dryer according to claim 1, wherein the exhaust duct comprises:

a first exhaust duct for exhausting air from the drum to an exterior of the case; and a second exhaust duct diverged from the first exhaust duct for exhausting a portion of the air exhausted from the drum to a front side of the suction duct.

15. The dryer according to claim 1, further comprising:

a fan for moving air between the suction duct and exhaust duct; and a driving motor, wherein the fan and the drum are rotated and driven by the driving motor.

16. The dryer according to claim 1, further comprising:

a fan for moving air between the suction duct and exhaust duct; and a first and a second driving motor, wherein the fan and the drum are each rotated and driven by the first and the second driving motors, respectively.

17. A clothes dryer comprising:

a case;

a drum having a rotatable body supported in the case, and a front plate and a rear plate engaged with stationary front and rear sides of the body;

a suction duct being connected to the rear plate of the drum supplying air to said drum for drying clothes;

an extension duct extending from the suction duct into the drum, wherein air supplied from the suction duct into the drum flows through said extension duct toward a rotational center of said drum; and an exhaust duct connected to the front plate of the drum for exhausting air to an exterior of said case, wherein the front plate of said drum includes a cylindrical portion extending a certain length in a longitudinal direction of the body from an outer circumferential surface of the drum, said cylindrical portion having an exhaust port at a lower portion thereof, and said exhaust duct is connected to the exhaust port of the cylindrical portion.

18. A clothes dryer comprising:

a case;

a drum having a rotatable body supported in the case, and a front plate and a rear plate engaged with stationary front and rear sides of the body;

a suction duct being connected to the rear plate of the drum supplying air to said drum for drying clothes;

an exhaust duct being connected to the front plate of the drum for exhausting air to an exterior of the case; and an air suction port formed on the rear plate of said drum and connected to the air suction port, wherein the air suction port is formed having a tapered shape increasing in area as the air suction port extends away from a rotational center of the drum.

19. A clothes dryer, comprising:

a case;

a drum rotatably supported in the case and having an interior space for drying clothes within said drum;

a suction duct being connected to a first side of the drum supplying air to said drum for drying clothes;

an extension duct extending from the suction duct into the drum, wherein air supplied from the suction duct into the drum flows through a plurality of air holes within said extension duct toward a rotational center of said drum;

a first exhaust duct being connected to a second side of the drum for exhausting air within said drum to the outside of the case; and a second exhaust duct diverging from the first exhaust duct for exhausting a portion of the air exhausted from the drum to a front side of the suction duct.

20. The dryer according to claim 19, further comprising a heater for heating suction air being installed at an inlet portion of the suction duct, wherein the exhaust duct recirculates a portion of the air exhausted from the exhaust duct into the drum by exhausting the air to a front side of the heater.

21. The dryer according to claim 8, wherein the air suction port which is not connected to the extension duct is formed having an inverted trapezoidal shape.

* * * * *